US005878957A

United States Patent [19]

Takado et al.

[11] Patent Number: 5,878,957

[45] Date of Patent: Mar. 9, 1999

[54] METHOD AND SYSTEM FOR PRECISE DISCHARGE DETERMINATION

[75] Inventors: Tsumoru Takado, Kumamoto; Akihisa Sakata, Kanagawa, both of Japan

[73] Assignee: NEC Corporation, Tokyo, Japan

[21] Appl. No.: 805,154

[22] Filed: Feb. 24, 1997

[30] Foreign Application Priority Data

Feb. 23, 1996 [JP] Japan ..... 8-036055

[51] Int. Cl.[6] ..... B05B 12/00

[52] U.S. Cl. ..... 239/71; 239/104

[58] Field of Search ..... 239/63, 65, 71, 239/101, 104, 119; 222/389, 61, 573

[56] References Cited

U.S. PATENT DOCUMENTS

| | | | |
|---|---|---|---|
| 4,052,003 | 10/1977 | Steffen | 239/71 |
| 4,675,301 | 6/1987 | Charneski et al. | 222/61 X |
| 4,833,748 | 5/1989 | Zimmer et al. | 239/71 X |
| 4,848,657 | 7/1989 | Hashimoto et al. | 239/71 X |
| 4,874,444 | 10/1989 | Satou et al. | 222/61 X |
| 5,277,333 | 1/1994 | Shimano | 222/61 X |
| 5,312,016 | 5/1994 | Brennan et al. | 239/63 X |
| 5,568,882 | 10/1996 | Takacs | 222/61 |

*Primary Examiner*—Lesley D. Morris
*Attorney, Agent, or Firm*—Young & Thompson

[57] ABSTRACT

A method of controlling an amount of a material discharged via a discharge nozzle from a container containing the material by applying a high pressure gas via a gas line system to an inside of the container. A reference pressure is detected which is of a gas confined in a restricted space having a predetermined volume in the gas line system. A high pressure is detected which is of a gas applied to the inside of the container. A residual amount of the material in the container is measured based upon the reference pressure and the high pressure. Both an optimum pressure level of the high pressure gas and an optimum pressure-applying time, during which the high pressure gas is applied to the inside of the container, are computed with reference to the residual amount of the material in the container so as to adjust both the high pressure and the pressure-applying time to an optimum pressure level and an optimum pressure-applying time thereby keeping a constant discharge amount of the material through the discharge nozzle.

21 Claims, 4 Drawing Sheets

METHOD AND SYSTEM FOR PRECISE DISCHARGE DETERMINATION

BACKGROUND OF THE INVENTION

The present invention relates to a method and a system for precise discharge determination, and more particularly to a method and a system for precise discharge determination for discharging a material such as resin at a constant discharge amount by utilizing an air pressure applied to the inside of a container containing the material to be discharged.

In the processes for fabricating a semiconductor device, a semiconductor chip is bonded to a lead frame. Prior to bonding the semiconductor chip onto the lead frame, it is necessary to have previously supplied a predetermined amount of adhesive onto the lead frame. The semiconductor chip is placed on the adhesive which has already been applied on the lead frame before the semiconductor chip is press-bonded to the lead frame. If the amount of the adhesive applied on the lead frame is insufficient, this results in an insufficient adhesive strength. If, however, the amount of the adhesive applied on the lead frame is excessive, the adhesive is spread to the periphery of the semiconductor chip. To avoid those problems, it is required to precisely control the amount of the adhesive to be applied onto the lead frame. For this purpose, there was proposed a discharge determination system for discharging a predetermined amount of the adhesive. The typical discharge determination discharge system is an air-pressure discharge determination system wherein pressured air is supplied into a container having contained the adhesive to cause the adhesive discharged via a discharge nozzle. This air-pressure discharge determination system is so designed as to enable easy control of the amount of the adhesive discharged by controlling the air pressure and the discharge time.

If a volume of the container containing the adhesive is not so high as compared to the amount of the adhesive discharged one time, this results in that the volume of air in the container is increased by discharge of the adhesive whereby the discharge pressure in the container is gradually reduced even though the air pressure applied into the container and the discharge time remain unchanged. As a result, the amount of the adhesive discharged becomes somewhat small.

In order to settle the above problems with a slight reduction in the amount of the adhesive, it was proposed that waveforms of the air pressure applied into the container containing the adhesive are detected for finding a difference between an integral value of the detected pressure waveforms and an integral value of the predetermined reference pressure waveforms so that the discharge condition is adjusted to compensate that difference. This technique is disclosed in the Japanese patent application No. 5-67057.

In the above discharge system, it is required to preliminarily obtain the reference pressure waveform by discharging as a test all of the adhesive from the container under the same condition as those intended to be selected. For this reason, such preliminary discharging test for obtaining the reference pressure waveform has to be carried out every time when the kinds and amount of the adhesive to be practically used are different. This complicated processes would be inconvenient for the user. Particularly if the volume of the container for containing the adhesive is large, then a long time is taken to completely discharge all of the adhesive stored in the container and such operation would be inefficient.

If accidentally any part of the air pressure system becomes inoperable, the pressure waveform of the actual discharge of the adhesive may largely differ from the reference pressure waveform. In this case, however, such accident might not be detected and thus the normal control of the discharge condition could never be made, for which reason it is no longer possible to make a proper control of the amount of the adhesive discharged, resulting in a large number of inferior products being produced.

Further if variation over time in electrical properties such as drift appears on the electric device such as amplifier or analog-to-digital converter provided in the discharge system, such variation might not be detected and thus the normal control of the discharge condition could never be made, for which reason it is no longer possible to make a proper control of the amount of the adhesive discharged, resulting in a large number of inferior products being produced.

In the above circumstances, it had not been required to develop novel method and system for precise determination discharge of the adhesive, which are capable of keeping the precise determination discharge by automatic compensation to any change of the discharge conditions such as the kind and amount of the adhesive and to variations of the discharge amount caused by any accident having appeared on the apparatus or by variation over time in electrical properties such as drift appears on the electric device such as amplifier or analog-to-digital converter provided in the discharge system.

SUMMARY OF THE INVENTION

Accordingly, it is an object of the present invention to provide a novel method of precise discharge determination of the adhesive, which is free from the above problems.

It is a further object of the present invention to provide a novel method of precise discharge determination of the adhesive, which is capable of keeping the precise discharge determination by automatic compensation to any change of the discharge conditions such as the kind and amount of the adhesive.

It is a further more object of the present invention to provide a novel method of precise discharge determination of the adhesive, which is capable of keeping the precise discharge determination by automatic compensation to variations of the discharge amount caused by any accident having appeared on the apparatus.

It is a still further object of the present invention to provide a novel method of precise discharge determination of the adhesive, which is capable of keeping the precise discharge determination by automatic compensation to variations of the discharge amount caused by variation over time in electrical properties such as drift appears on the electric device such as amplifier or analog-to-digital converter provided in the discharge system.

It is yet a further object of the present invention to provide a novel method of precise discharge determination of the adhesive, which is capable of finding out any accident having appeared on the apparatus in early stage.

It is another object of the present invention to provide a novel system of precise discharge determination of the adhesive, which is free from the above problems.

It is still another object of the present invention to provide a novel system of precise discharge determination of the adhesive, which is capable of keeping the precise discharge determination by automatic compensation to any change of the discharge conditions such as the kind and amount of the adhesive.

It is yet another object of the present invention to provide a novel system of precise discharge determination of the adhesive, which is capable of keeping the precise discharge determination by automatic compensation to variations of the discharge amount caused by any accident having appeared on the apparatus.

It is further another object of the present invention to provide a novel system of precise discharge determination of the adhesive, which is capable of keeping the precise determination discharge by automatic compensation to variations of the discharge amount caused by variation over time in electrical properties such as drift appears on the electric device such as amplifier or analog-to-digital converter provided in the discharge system.

It is moreover object of the present invention to provide a novel system of precise discharge determination of the adhesive, which is capable of finding out any accident having appeared on the apparatus in early stage.

The above and other objects, features and advantages of the present invention will be apparent from the following descriptions.

The present invention provides a system of discharging a material stored in a container through a discharge nozzle by an air pressure applied to an inside of the container. The system comprises the following elements. A high pressure supply is provided which is connected via an air line system to the container for supplying a high pressure air to the inside of the container. A vacuum pressure supply is provided which is connected via the air line system to the container for applying a vacuum pressure to the inside of the container. A pressure detector is provided which is connected to the air line system for detecting a high pressure of the air line system to substantially detect a high pressure of the inside of the container when the high pressure is applied to the inside of the container. The pressure detector also detects, as a reference pressure, a vacuum pressure of a restricted space region in the air line system when the vacuum pressure is applied to the inside of the container. A residual amount computing device is provided which is electrically connected to the pressure detector for receipt of the high pressure and the reference pressure and computing a residual amount of the resin in the container based upon both the high pressure and the reference pressure. A pressure level and time adjusting device is provided which is connected on the air line system between the high pressure air supply and the container for adjusting both a pressure level of a supplying air through the air line system and a pressure-applying time during which the high pressure air is applied to the inside of the container. The pressure level and time adjusting device is further electrically connected to the residual amount computing device for receiving an information about the residual amount of the material in the container so that the pressure level and time adjusting device adjusts both the pressure level and the pressure-applying time in accordance with the residual amount of the material in the container to keep a constant discharge amount of the material through the discharge nozzle.

The present invention also provides a system of discharging a material stored in a container through a discharge nozzle by a gas pressure applied to an inside of the container. The system comprises the following elements. A high pressure supply is provided which is connected via a gas line system to the container for supplying a high pressure gas to the inside of the container. A pressure detector is provided which is connected to the gas line system for detecting a high pressure of the gas line system to substantially detect a high pressure of the inside of the container when the high pressure is applied to the inside of the container. The pressure detector also detects a reference pressure of a restricted space region in the gas line system when the high pressure is not applied to the inside of the container. A controller is also provided which is electrically connected to the pressure detector for receipt of the high pressure and the reference pressure and computing a residual amount of the resin in the container based upon both the high pressure and the reference pressure in order to adjust both a pressure level of a supplying gas through the gas line system and a pressure-applying time, during which the high pressure gas is applied to the inside of the container, with reference to the residual amount of the material in the container to thereby keep a constant discharge amount of the material through the discharge nozzle.

The present invention also provides a method of adjusting an amount of a material discharged via a discharge nozzle from a container containing the material by applying a high pressure gas via a gas line system to an inside of the container. The method comprises the following steps. A reference pressure is detected which is of a gas confined in a restricted space having a predetermined volume in the gas line system. A high pressure is detected which is of a gas applied to the inside of the container. A residual amount of the material in the container is measured based upon the reference pressure and the high pressure. Both a pressure level of the high pressure gas and a pressure-applying time, during which the high pressure gas is applied to the inside of the container, are adjusted with reference to the residual amount of the material in the container to thereby keep a constant discharge amount of the material through the discharge nozzle.

The present invention also provides a method of controlling an amount of a material discharged via a discharge nozzle from a container containing the material by applying a high pressure gas via a gas line system to an inside of the container. The method comprises the following steps. A reference pressure is detected which is of a gas confined in a restricted space having a predetermined volume in the gas line system. A high pressure is detected which is of a gas applied to the inside of the container. A residual amount of the material in the container is measured based upon the reference pressure and the high pressure. Both an optimum pressure level of the high pressure gas and an optimum pressure-applying time, during which the high pressure gas is applied to the inside of the container, are computed with reference to the residual amount of the material in the container so as to adjust both the high pressure and the pressure-applying time to an the optimum pressure level and the optimum pressure-applying time thereby keeping a constant discharge amount of the material through the discharge nozzle.

BRIEF DESCRIPTIONS OF THE DRAWINGS

Preferred embodiments according to the present invention will be described in detail with reference to the accompanying drawings.

DISCLOSURE OF THE INVENTION

Figure 1:
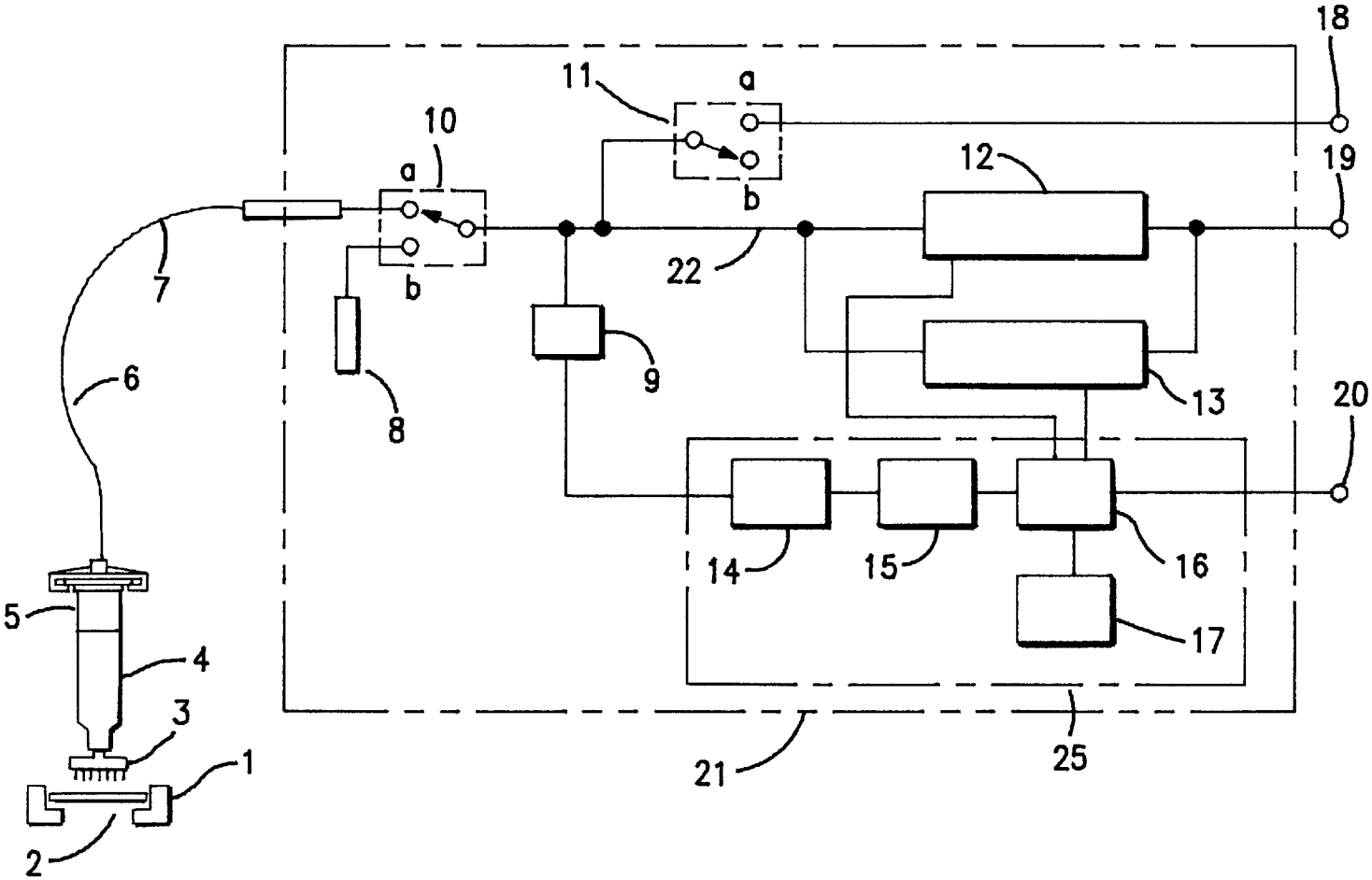
FIG. 1 is a diagram illustrative of a novel system of precise determination discharge of the adhesive in a first embodiment according to the present invention.

The present invention provides a system of discharging a material stored in a container through a discharge nozzle by an air pressure applied to an inside of the container. The system comprises the following elements. A high pressure supply is provided which is connected via an air line system to the container for supplying a high pressure air to the inside of the container. A vacuum pressure supply is provided which is connected via the air line system to the container for applying a vacuum pressure to the inside of the container. A pressure detector is provided which is connected to the air line system for detecting a high pressure of the air line system to substantially detect a high pressure of the inside of the container when the high pressure is applied to the inside of the container. The pressure detector also detects, as a reference pressure, a vacuum pressure of a restricted space region in the air line system when the vacuum pressure is applied to the inside of the container. A residual amount computing device is provided which is electrically connected to the pressure detector for receipt of the high pressure and the reference pressure and computing a residual amount of the resin in the container based upon both the high pressure and the reference pressure. A pressure level and time adjusting device is provided which is connected on the air line system between the high pressure air supply and the container for adjusting both a pressure level of a supplying air through the air line system and a pressure-applying time during which the high pressure air is applied to the inside of the container. The pressure level and time adjusting device is further electrically connected to the residual amount computing device for receiving an information about the residual amount of the material in the container so that the pressure level and time adjusting device adjusts both the pressure level and the pressure-applying time in accordance with the residual amount of the material in the container to keep a constant discharge amount of the material through the discharge nozzle.

It is possible to further provide an atmospheric pressure supply which is connected via the air line system to the container for supplying an atmospheric pressure air to the inside of the container.

It is possible that an empty subordinate container having a predetermined constant volume is provided which is connected via a switching valve to the air line system in parallel to the container containing the material so that the switching valve is switched to connect the empty subordinate container to the air line system for enabling the pressure detector to measure the reference pressure, whilst the switching valve is switched to connect the container to the air line system for enabling the pressure detector to measure a pressure of the container.

It is also possible that a secondary switching valve is provided which is connected via a subordinate air line to the switching valve and also connected to the pressure detector as well as connected to the container in parallel to the switching valve so that the secondary switching valve is switched to connect the pressure detector to the subordinate air line for enabling the pressure detector to measure the reference pressure provided that the switching valve connects the subordinate air line to the air line system, whilst the secondary switching valve is switched to connect the pressure detector to the container for enabling the pressure detector to measure the pressure of the container provided that the switching valve connects the container to the air line system.

It is also possible that the residual amount computing device includes a memory for storing information about the reference pressure by the pressure detector and a processing unit electrically connected to the memory for fetching the information about the reference pressure and also electrically connected to the pressure detector for fetching the pressure of the container so that the processing unit does compute the residual amount of the material detected by comparing the reference pressure to the pressure of the container.

The present invention also provides a system of discharging a material stored in a container through a discharge nozzle by a gas pressure applied to an inside of the container. The system comprises the following elements. A high pressure supply is provided which is connected via a gas line system to the container for supplying a high pressure gas to the inside of the container. A pressure detector is provided which is connected to the gas line system for detecting a high pressure of the gas line system to substantially detect a high pressure of the inside of the container when the high pressure is applied to the inside of the container. The pressure detector also detects a reference pressure of a restricted space region in the gas line system when the high pressure is not applied to the inside of the container. A controller is also provided which is electrically connected to the pressure detector for receipt of the high pressure and the reference pressure and computing a residual amount of the resin in the container based upon both the high pressure and the reference pressure in order to adjust both a pressure level of a supplying gas through the gas line system and a pressure-applying time, during which the high pressure gas is applied to the inside of the container, with reference to the residual amount of the material in the container to thereby keep a constant discharge amount of the material through the discharge nozzle.

It is possible to further provide an atmospheric pressure supply which is connected via the gas line system to the container for supplying an atmospheric pressure air to the inside of the container.

It is also possible that an empty subordinate container having a predetermined constant volume is provided which is connected via a switching valve to the gas line system in parallel to the container containing the material so that the switching valve is switched to connect the empty subordinate container to the gas line system for enabling the pressure detector to measure the reference pressure, whilst the switching valve is switched to connect the container to the gas line system for enabling the pressure detector to measure a pressure of the container.

It is also possible that a secondary switching valve is provided which is connected via a subordinate gas line to the switching valve and also connected to the pressure detector as well as connected to the container in parallel to the switching valve so that the secondary switching valve is switched to connect the pressure detector to the subordinate gas line for enabling the pressure detector to measure the reference pressure provided that the switching valve connects the subordinate air line to the air line system, whilst the secondary switching valve is switched to connect the pressure detector to the container for enabling the pressure detector to measure the pressure of the container provided that the switching valve connects the container to the gas line system.

It is possible that the controller includes a memory for storing information about the reference pressure detected by the pressure detector and a processing unit electrically connected to the memory for fetching the information about the reference pressure and also electrically connected to the pressure detector for fetching the pressure of the container so that the processing unit does compute the residual amount of the material by comparing the reference pressure to the pressure of the container.

It is possible to further provide a vacuum pressure supply which is connected via the gas line system to the container for applying a vacuum pressure to the inside of the container so that the pressure detector detects the reference pressure.

The present invention also provides a method of adjusting an amount of a material discharged via a discharge nozzle from a container containing the material by applying a high pressure gas via a gas line system to an inside of the container. The method comprises the following steps. A reference pressure is detected which is of a gas confined in a restricted space having a predetermined volume in the gas line system. A high pressure is detected which is of a gas applied to the inside of the container. A residual amount of the material in the container is measured based upon the reference pressure and the high pressure. Both a pressure level of the high pressure gas and a pressure-applying time, during which the high pressure gas is applied to the inside of the container, are adjusted with reference to the residual amount of the material in the container to thereby keep a constant discharge amount of the material through the discharge nozzle.

It is possible to further comprise the step of applying an atmospheric pressure to the gas line system and the container to stabilize a gas pressure of the gas line system and the container before detecting the high pressure.

The present invention also provides a method of controlling an amount of a material discharged via a discharge nozzle from a container containing the material by applying a high pressure gas via a gas line system to an inside of the container. The method comprises the following steps. A reference pressure is detected which is of a gas confined in a restricted space having a predetermined volume in the gas line system. A high pressure is detected which is of a gas applied to the inside of the container. A residual amount of the material in the container is measured based upon the reference pressure and the high pressure. Both an optimum pressure level of the high pressure gas and an optimum pressure-applying time, during which the high pressure gas is applied to the inside of the container, are computed with reference to the residual amount of the material in the container so as to adjust both the high pressure and the pressure-applying time to an the optimum pressure level and the optimum pressure-applying time thereby keeping a constant discharge amount of the material through the discharge nozzle.

It is possible to further comprise the step of applying an atmospheric pressure to the gas line system and the container to stabilize a gas pressure of the gas line system and the container before detecting the high pressure.

PREFERRED EMBODIMENTS

A first embodiment according to the present invention will be described with reference to FIGS. 1, 2A, 2B and 3, wherein novel method and system of precise determination discharge of the adhesive, which are capable of keeping the precise determination discharge by automatic compensation to any change of the discharge conditions such as the kind and amount of the adhesive and to variations of the discharge amount caused by any accident having appeared on the apparatus or by variation over time in electrical properties such as drift appears on the electric device such as amplifier or analog-to-digital converter provided in the discharge system. The system of precise determination discharge of the adhesive is provided on a semiconductor device production line for supplying a adhesive resin onto a lead flame to be bonded with a semiconductor chip.

A discharge system 21 is connected via a connection tube 6 to a container 5 for supplying an pressured air into the container 5 to discharge a resin stored in the container 5. The container 5 has a discharge nozzle 3 through which the resin 4 is discharged onto a lead frame 2 which is carried on a carrier rail 1. The discharge system 21 has a discharge port 7 which is coupled to the connection tube 6. The amount of the resin 4 discharged from the discharge nozzle 3 of the container 5 depends upon the air pressure applied through the connection tube 6 into the container 5. The discharge system 21 has an air intake 18 connected to an atmosphere for causing an air to enter into the discharge system 21. The discharge system 21 has a high pressure air supply port 19 connected to a high pressure air supply so that a high pressure air is supplied through the high pressure air supply port 19 into the discharge system 21. The inter-tube 22 is provided to connect the air intake 18 to the discharge port 7 and also connect the high pressure air supply port 19 to the discharge port 7. A first electromagnetic valve 10 is provided which is connected to the discharge port 7 and a predetermined volume container 8 so that selectively connect the inter-tube 22 to any one of the discharge port 7 and the predetermined volume container 8. The inter-tube 22 connects the air intake 18 to the first electromagnetic valve 10. The inter-tube 22 connects the high pressure air supply port 19 to the first electromagnetic valve 10. A second electromagnetic valve 11 is provided on the inter-tube 22 between the first electromagnetic valve 10 and the air intake 18 so that the second electromagnetic valve 11 selects whether or not the inter-tube 22 is connected to the air intake 18. Further, a discharge control section 12 and a vacuum control section 13 are connected in parallel to each other between the first electromagnetic valve 10 and the high pressure air supply port 19 so that the high pressure air supply port 19 is connected through the discharge control section 12 and the vacuum control section 13 to the first electromagnetic valve 10. The discharge system 21 has a discharge initiating instruction terminal 20. The discharge system 21 has a control section 25 which is coupled to the discharge initiating instruction terminal 20 for receipt of discharge initiating instruction from the discharge initiating instruction terrminal 20. The discharge system 21 has a pressure sensor 9 which is connected between the inter-tube 22 and the control section 25 so that the control section 25 is connected through the pressure sensor 9 to the first electromagnetic valve 10. The control section 25 comprises an amplifier 14, an A,D converter 15, a CPU 16 and a memory 17. The amplifier 14 is connected to the pressure sensor 9. The A/D converter 15 is connected to the amplifier 14. The CPU 16 is connected to the A/D converter 15 and connected to the discharge initiating instruction terminal 20. The memory 17 is connected to the CPU 16. The CPU 16 receives the discharge initiating instruction from the discharge initiating instruction terminal 20. The CPU 16 also receives an information about an air pressure of the inter-tube 22 detected by the pressure sensor 9 through the amplifier 14 and the A/D converter 15. The CPU 16 is connected to the discharge control section 12 for controlling operations of the discharge control section 12. The CPU 16 is further connected to the vacuum control section 13 for controlling operations of the vacuum control section 13. The vacuum control section 13 has a vacuum generator for causing a vacuum pressure in the inter-tube 22. The CPU 16 controls operations of the discharge control section 12 and the vacuum control section 13 under the informations of the air pressure of the inter-tube 22. The amplifier 14 fetches the detected signals of the air pressure of the inter-tube 22 from the pressure sensor 9 to amplify the detected air pressure signals. The A/D converter 15 fetches the amplified air pressure signals from the amplifier 14 to carry out the analog-to-digital conversion of the amplified air pressure signals. The CPU 16 receives the analogto-digital converted air pressure signal based upon which the CPU 16 controls operations of the discharge control section 12 and the vacuum control section 13. The memory stores informations such as arithmetic expression necessary for verifying the amount of the residual resin in the container 5.

Operations of the above discharge system 21 will be described as follows. The lead frame 2 is carried on the carrier rail 1 and positioned at a predetermined position before the pressured air is supplied from the discharge system 21 through the discharge port 7 and the connection tube 6 into the inside of the container 5 containing the resin 4 whereby the resin 4 is pushed out of the discharge nozzle 3 and supplied onto the lead frame 2. The resin-applied lead frame 2 is then carried on the carrier rail 1 up to the next position where a semiconductor chip is placed on the resin-applied lead frame 2 and then pressed thereonto for bonding between the semiconductor chip and the lead frame 2.

If the discharge system 21 enters into the non-discharging state in which no resin is discharged, then the container 5 is vacuumed to prevent the resin 4 in the container 5 from dropping by the own weight onto the lead frame 2. For this propose, the first electromagnetic valve 10 is operated to select a position "a" to connect the inter-tube 22 to the discharge port 7. The second electromagnetic valve 11 is operated to select a position "a" to connect the inter-tube 22 to the air intake 18 so that the inter-tube 22 has the same internal air pressure as the atmosphere. At this time, the discharge control section 12 and the vacuum control section 13 are controlled by the control section 25 to generate no output. After a predetermined time has been passed, the second electromagnetic valve 11 is switched into a position "b" so that the inter-tube 22 and the connection tube 6 are disconnected from the air intake 18 whereby the internal pressure becomes stable. The vacuum control section 13 is controlled to vacuum the air in the inter-tube 22 and the connection tube 6 as well as in the container 5 so that the pressure of the airs in the inter-tube 22 and the connection tube 6 as well as in the container 5 is reduced to the vacuum pressure. After the container 5 is vacuumed, it is possible to prevent the resin 4 from being dropped through the discharge nozzle 3. The pressure sensor 9 detects the air pressure of the inter-tube 22 to substantially detect the air pressure inside the container 5. The pressure sensor 9 generates analog signals of the air pressure detected. The analog signal of the air pressure is fetched and amplified by the amplifier 14. The amplified analog signal of the air pressure is fetched and analog-to-digital converted by the A/D converter 15 to generate digital signals of the air pressure. The digital signals of the air pressure is then fetched by the CPU 16 and transferred into the memory 17 for causing the memory 17 to store the digital signals of the air pressure as a measured air pressure value.

Subsequently, the first electromagnetic valve 10 is switched into a position "b" to connect the inter-tube 22 to the predetermined volume container 8. The second electromagnetic valve 11 is switched into a position "a" so that the inter-tube 22 and the predetermined volume container 8 are connected to the air intake 18 so as to cause the inter-tube 22 and the predetermined volume container 8 to have the same air pressure as the atmosphere. At this time, the discharge control section 12 and the vacuum control section 13 are controlled by the control section 25 to generate no output. After a predetermined time has been passed, the second electromagnetic valve 11 is switched into a position "b" so that the inter-tube 22 and the predetermined volume container 8 are disconnected from the air intake 18 whereby the internal pressure becomes stable. The vacuum control section 13 is controlled to vacuum the air in the inter-tube 22 and the predetermined volume container 8 so that the pressure of the airs in the inter-tube 22 and the predetermined volume container 8 is reduced to the vacuum pressure. The pressure of the air is almost the same between the predetermined volume container 8 and the inter-tube 22. The pressure sensor 9 detects the air pressure of the inter-tube 22 to substantially detect the air pressure inside the predetermined volume container 8. The pressure sensor 9 generates analog signals of the air pressure which will be hereinafter referred to as "reference air pressure value". The analog signal of the reference air pressure is fetched and amplified by the amplifier 14. The amplified analog signal of the air pressure is fetched and analog-to-digital converted by the A/D converter 15 to generate digital signals of the reference air pressure. The digital signals of the reference air pressure is then fetched by the CPU 16 and transferred into the memory 17 for causing the memory 17 to store the digital signals of the reference air pressure as a measured air pressure value. As a result, the internal pressures of the container 5, the connection tube 6 and the predetermined volume container 8 are measured as the reference air pressure under the same measuring conditions by the same pressure sensor 9. This means that if temperature variation and further variations in conditions over times appear, then a relationship between the internal air pressure of the container to be measured and the reference air pressure is unchanged. The above vacuum pressure is a pressure which provides no effect to the discharge of the resin 4. In place of the atmospheric pressure, a slightly higher pressure than the atmospheric pressure may also be available to measure the reference air pressures.

Subsequently, the first electromagnetic valve 10 is switched into the position "a" to connect the inter-tube 22 to the connection tube 6 and the container 5. The second electromagnetic valve 11 is switched into a position "b" so that the inter-tube 22 and the container 5 are connected to the high pressure air supply port 19 so as to supply the high pressure air to the inter-tube 22 and the container 5 whereby the inter-tube 22 and the container 5 have the high pressure which is almost the same pressure as the high pressure air supply port 19. At this time, the discharge control section 12 and the vacuum control section 13 are controlled by the control section 25 to enter into the operational state. The high pressure applied to the container 5 causes the resin 4 in the container 5 to be discharged from the discharge nozzle 3. As the resin 4 is discharged through the discharge nozzle 3 and the volume of the resin 4 in the container 5 is reduced, then the volume of the air in the container 5 is by contrast increased until all of the resin 4 in the container has been discharged and no residual resin 4 is present in the container 5 so that the volume of the air in the container 5 becomes maximum.

The increase in the volume of the air in the container 5 causes a variation in discharge pressure of the air in the container 5 even the constant high pressure remains applied to the container 5. Such variation in the discharge pressure of the air in the container 5 causes variations in the discharge amount of the resin 4. Optimum air pressure and pressure-applying time for ensuring stable and uniform discharge amount of the resin 4 against the variation in the volume of the air in the container 5 can be found experimentally. The experiment of discharging the resin has previously been carried out one time so that the profiles of the air pressure and the pressure-applying times have been obtained and measured values of the air pressure and the pressure-applying times are once stored in the memory 5. Thereafter, the internal air pressure of the container 5 or the amount of the residual resin 4 in the container 5 is measured to set or keep the optimum discharge conditions. Namely, the internal air pressure of the container 5 is varied depending upon the amount of the residual resin 4 in the container 5. The CPU 16 compares this variable internal air pressure of the container 5 to the air pressure of the predetermined volume container 8 to calculate the air volume or the volume of the residual resin 4.

The amount or volume of the residual resin 4 in the container 5 can be found from a difference or a rate between the measured pressure value and the reference pressure value, for which reason the amount of the residual resin 4 is found for subsequent comparison of the currently measured pressure value to the previously measured value stored in the memory 17 to compensate the air pressure so as to obtain optimum air pressure and air supply time or the pressure-applying time. Based upon those optimum air pressure and air supply time, the CPU 16 controls the discharge control section 12 to generate the optimum air pressure which is applied through the inter-tube 22 and the connection tube 6 to the container 5 whereby the contact amount of the resin is discharged anytime.

Figure 2B:
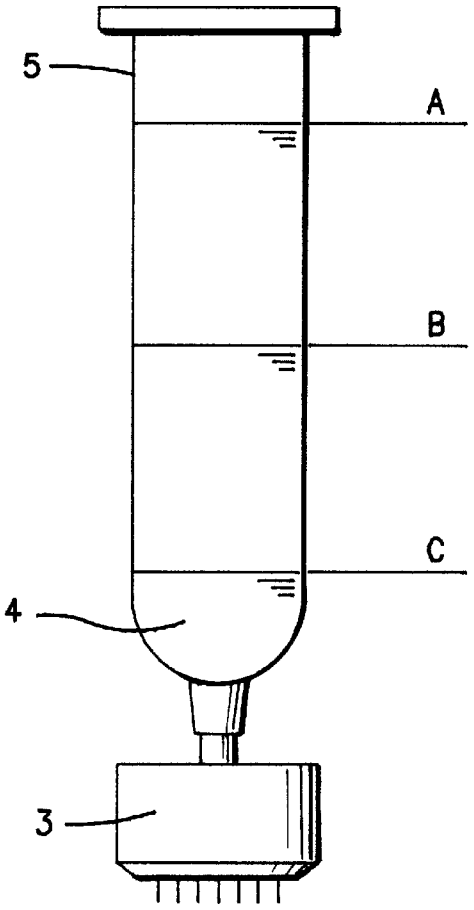
FIG. 2A is a diagram illustrative of variations of internal pressure having been translated and normalized over the amount of residual adhesive in the container, illustrated by FIG. 2B and of a container for containing the adhesive in accordance with the present invention.
Figure 2A:
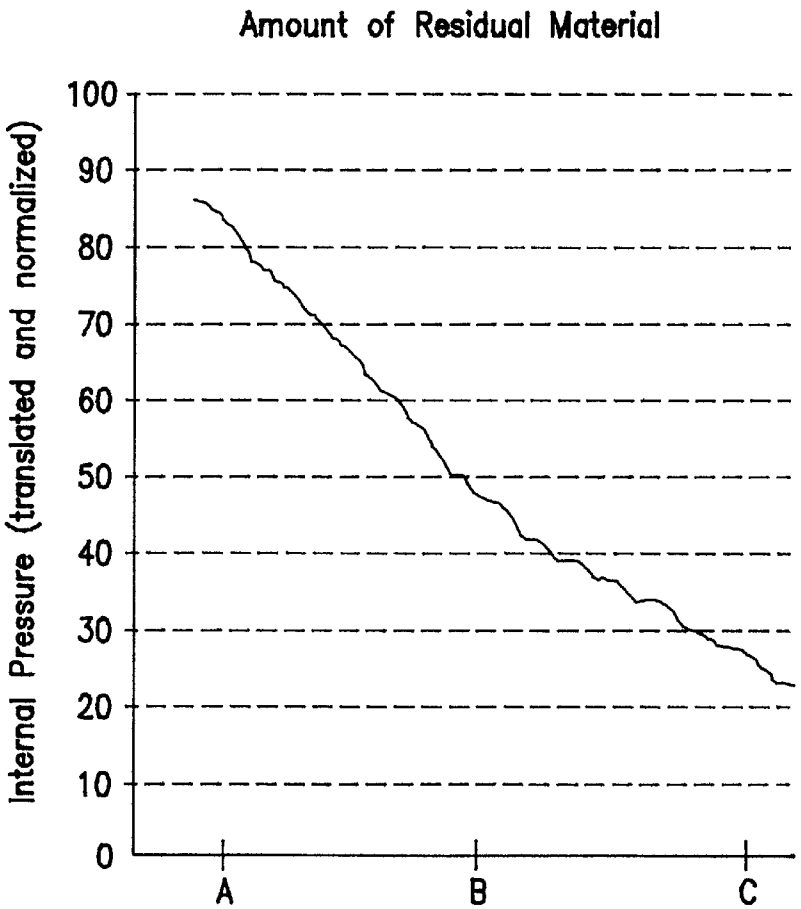

FIG. 2A is illustrative of variations of internal pressure having been translated and normalized over the amount of residual resin 4 in the container 5 (FIG. 2A). The internal pressure is by compensation of a difference between the measured air pressure and the reference air pressure by off-set based upon the actually measured value stored in the memory 17. When the internal pressure is not less than 90, the connection tube 6 is disconnected from the inter-tube 22 via the discharge port 7 closed. If the internal pressure is not more than 20, this means that the air path in the downstream side from the discharge port 7 is opened or that any air leakage appears on the air pipeline. If the internal air pressure is below 90 and above 20, the amount of the resin discharged can precisely be controlled depending upon the residual resin 4 in the container 5. This teaches that the discharge amount of the resin 4 can precisely be controlled even when the discharge amount of the resin 4 is varied.

Figure 3:
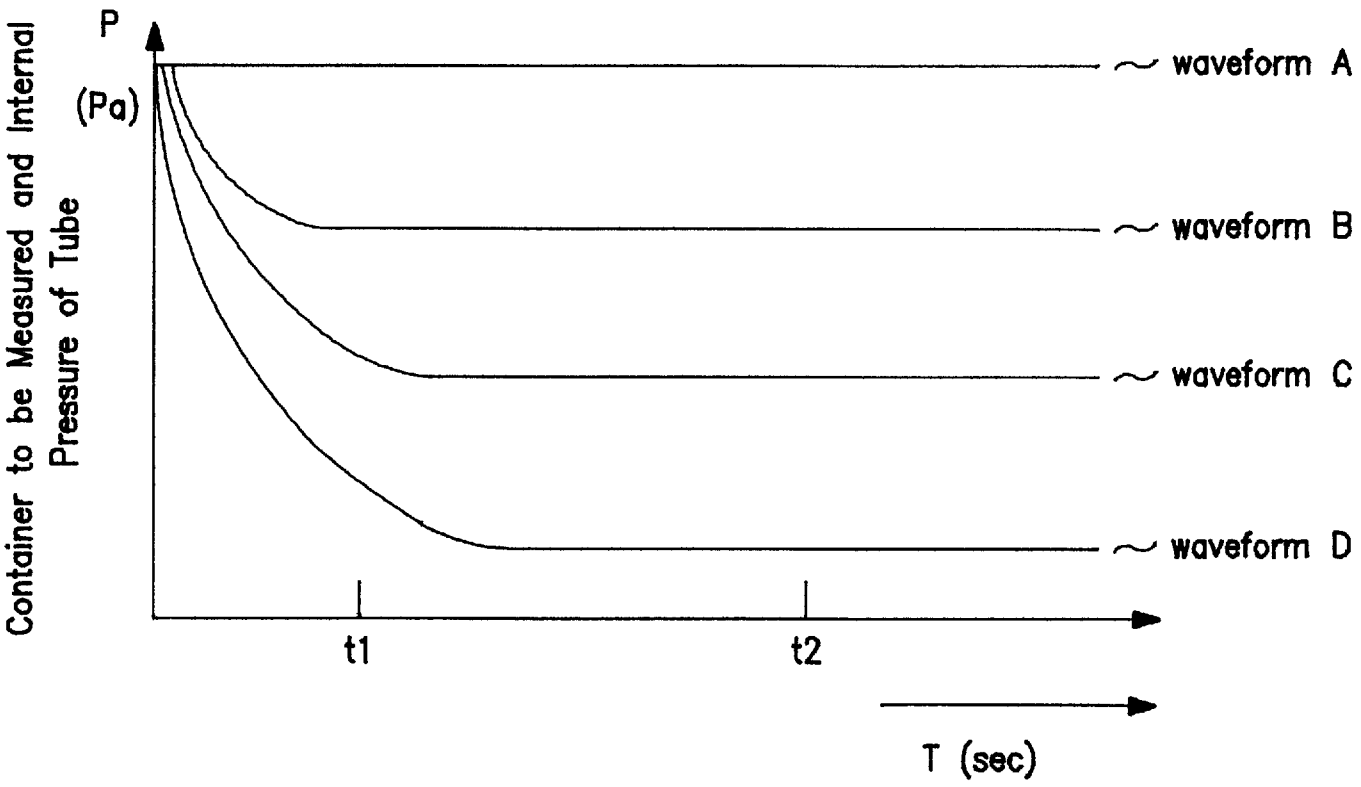
FIG. 3 is a diagram illustrative of internal pressure of the container and tube in accordance with the present invention.

FIG. 3 illustrates that any abnormal state having appeared on the air pressure line can be detected only by measuring the air pressure. At a time T1, the air pressure is in the transient state. The above discharge system 21 enables detection of any abnormal state having appeared on the air pressure line even in the transient time duration. At a time T2, the air pressure is in the stable state. The above discharge system 21 enables detection of any abnormal state having appeared on the air pressure line of course in the stable state of the air pressure. A waveform "A" represents an abnormal air pressure waveform when the connection tube 6 is not coupled to the container 5 and the inter-tube 22 has the atmospheric pressure. A waveform "B" represents an abnormal air pressure waveform when any air leakage appears on the connection portion on the air line. A waveform "C" represents the normal air pressure waveform. A waveform "D" represents an abnormal air pressure waveform when the connection tube 6 is not coupled to the discharge port 7. It is possible to detect any abnormal state of the air line by measuring the air pressure and verifying the air pressure waveform.

According to the above discharge system of the second embodiment of the present invention, the reference air pressure value is obtained by measuring the pressure of the air in a defined space having a predetermined or already known volume. The container air pressure value is obtained by measuring the pressure of the air in the container containing the resin. The amount of the residual resin in the container is found based upon both the reference air pressure value and the container air pressure value. The air pressure applied to the container containing the resin is controlled with reference to the amount of the residual resin in the container to always discharge the constant amount of the resin independent from the amount of the residual resin in the container.

Further, the above discharge system enables detection of any abnormal state having appeared on the air line system such as air leakage or disconnection between individual elements.

Figure 4:
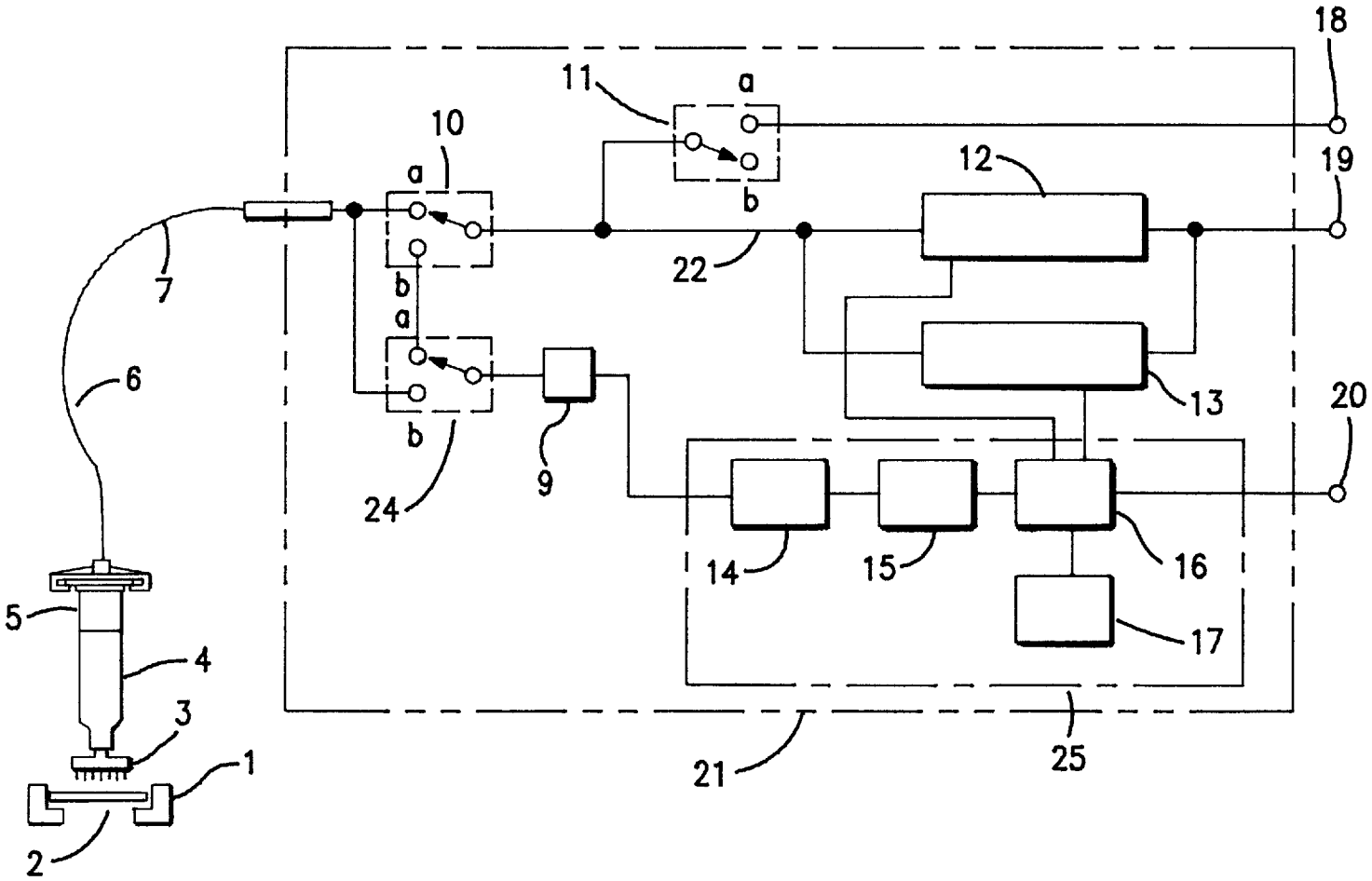
FIG. 4 is a diagram illustrative of a novel system of precise determination discharge of the adhesive in a second embodiment according to the present invention.

A second embodiment according to the present invention will be described with reference to FIG. 4, wherein novel method and system of precise determination discharge of the adhesive resin, which are capable of keeping the precise determination discharge by automatic compensation to any change of the discharge conditions such as the kind and amount of the adhesive and to variations of the discharge amount caused by any accident having appeared on the apparatus or by variation over time in electrical properties such as drift appears on the electric device such as amplifier or analog-to-digital converter provided in the discharge system. The system of precise determination discharge of the adhesive is provided on a semiconductor device production line for supplying a adhesive resin onto a lead frame to be bonded with a semiconductor chip.

A discharge system 21 is connected via a connection tube 6 to a container 5 for supplying an pressured air into the container 5 to discharge a resin stored in the container 5. The container 5 has a discharge nozzle 3 through which the resin 4 is discharged onto a lead frame 2 which is carried on a corner rail 1. The discharge system 21 has a discharge port 7 which is coupled to the connection tube 6. The amount of the resin 4 discharged from the discharge nozzle 3 of the container 5 depends upon the air pressure applied through the connection tube 6 into the container 5. The discharge system 21 has an air intake 18 connected to an atmosphere for causing an air to enter into the discharge system 21. The discharge system 21 has a high pressure air supply port 19 connected to a high pressure air supply so that a high pressure air is supplied through the high pressure air supply port 19 into the discharge system 21. The inter-tube 22 is provided to connect the air intake 18 to the discharge port 7 and also connect the high pressure air supply port 19 to the discharge port 7. A first electromagnetic valve 10 is provided which is connected to the discharge port 7 and a predetermined volume container 8 so that selectively connect the inter-tube 22 to any one of the discharge port 7 and the predetermined volume container 8. The inter-tube 22 connects the air intake 18 to the first electromagnetic valve 10. The inter-tube 22 connects the high pressure air supply port 19 to the first electromagnetic valve 10. A second electromagnetic valve 11 is provided on the inter-tube 22 between the first electromagnetic valve 10 and the air intake 18 so that the second electromagnetic valve 11 selects whether or not the inter-tube 22 is connected to the air intake 18. Further, a discharge control section 12 and a vacuum control section 13 are connected in parallel to each other between the first electromagnetic valve 10 and the high pressure air supply port 19 so that the high pressure air supply port 19 is connected through the discharge control section 12 and the vacuum control section 13 to the first electromagnetic valve 10. The discharge system 21 has a discharge initiating instruction terminal 20. The discharge system 21 has a control section 25 which is coupled to the discharge initiating instruction terminal 20 for receipt of discharge initiating instruction from the discharge initiating instruction terminal 20. The discharge system 21 has a third electromagnetic valve 24 which is connected through a second inter-tube 23 to the first electromagnetic valve 10. The third electromagnetic valve 24 is also connect to the discharge port 7. The first and third electromagnetic valves 10 and 24 are connected to the discharge port 7 in parallel to each other. The third electromagnetic valve 24 is also connected through a pressure sensor 9 to the control section 25 so that the control section 25 is connected through the pressure sensor 9 to the third electromagnetic valve 24. If the first electromagnetic valve 10 selects a position "a", then the discharge port 7 is connected to the first inter-tube 22. If the first electromagnetic valve 10 selects a position "b", then the first inter-tube 22 is connected to the second inter-tube 23. If the third electromagnetic valve 24 selects a position "a", then the pressure sensor 9 is connected to the second inter-tube 23. If, however, the third electromagnetic valve 24 selects a position "b", then the pressure sensor 9 is connected to the discharge port 7.

The control section 25 comprises an amplifier 14, an A/D converter 15, a CPU 16 and a memory 17. The amplifier 14 is connected to the pressure sensor 9. The A/ID converter 15 is connected to the amplifier 14. The CPU 16 is connected to the AID converter 15 and connected to the discharge initiating instruction terminal 20. The memory 17 is connected to the CPU 16. The CPU 16 receives the discharge initiating instruction from the discharge initiating instruction terminal 20. The CPU 16 also receives an information about an air pressure of the inter-tube 22 detected by the pressure sensor 9 through the amplifier 14 and the AID converter 15. The CPU 16 is connected to the discharge control section 12 for controlling operations of the discharge control section 12. The CPU 16 is further connected to the vacuum control section 13 for controlling operations of the vacuum control section 13. The vacuum control section 13 has a vacuum generator for causing a vacuum pressure in the inter-tube 22. The CPU 16 controls operations of the discharge control section 12 and the vacuum control section 13 under the information of the air pressure of the inter-tube 22. The amplifier 14 fetches the detected signals of the air pressure of the inter-tube 22 from the pressure sensor 9 to amplify the detected air pressure signals. The AID converter 15 fetches the amplified air pressure signals from the amplifier 14 to carry out the analog-to-digital conversion of the amplified air pressure signals. The CPU 16 receives the analog-to-digital converted air pressure signal based upon which the CPU 16 controls operations of the discharge control section 12 and the vacuum control section 13. The memory 17 stores information such as arithmetic expression necessary for verifying the amount of the residual resin in the container 5.

Operations of the above discharge system 21 will be described as follows. The lead frame 2 is carried on the carrier rail 1 and positioned at a predetermined position before the pressured air is supplied from the discharge system 21 through the discharge port 7 and the connection tube 6 into the inside of the container 5 containing the resin 4 whereby the resin 4 is pushed out of the discharge nozzle 3 and supplied onto the lead frame 2. The resin-applied lead frame 2 is then carried on the carrier rail 1 up to the next position where a semriconductor chip is placed on the resin-applied lead frame 2 and then pressed thereonto for bonding between the semiconductor chip and the lead frame 2.

If the discharge system 21 enters into the non-discharging state in which no resin is discharged, then the container 5 is vacuumed to prevent the resin 4 in the container 5 from dropping by the own weight onto the lead frame 2. For this propose, the first electromagnetic valve 10 is operated to select a position "a" to connect the inter-tube 22 to the discharge port 7. The second electromagnetic valve 11 is operated to select a position "a" to connect the inter-tube 22 to the air intake 18 so that the inter-tube 22 has the atmospheric pressure. The third electromagnetic valve 24 is operated to select a position "a" to connect the second inter-tube 23 to the pressure sensor 9. At this time, the discharge control section 12 and the vacuum control section 13 are controlled by the control section 25 to generate no output. After a predetermined time has been passed, the second electromagnetic valve 11 is switched into a position "b" so that the inter-tube 22 and the connection tube 6 are disconnected from the air intake 18 whereby the internal pressure becomes stable. The second electromagnetic valve 11 is switched to select a position "b" to connect the first inter-tube 22 to the second inter-tube 23 so that the pressure sensor 23 detect the air pressure of the first and second inter-tubes 22 and 23. The pressure sensor 9 generates analog signals of the air pressure detected. The analog signal of the air pressure is fetched and amplified by the amplifier 14. The amplified analog signal of the air pressure is fetched and analog-to-digital converted by the A/D converter 15 to generate digital signals of the air pressure. The digital signals of the air pressure is then fetched by the CPU 16 and transferred into the memory 17 for causing the memory 17 to store the digital signals of the air pressure as a reference air pressure value. The second electromagnetic valve 11 remains to select the position "b". The first electromagnetic valve 10 is switched to select the position "a" to connect the first inter-tube 22 to the discharge port 7. The third electromagnetic valve 24 is switched to select the position "b" so that the pressure sensor 9 detects the air pressure of the container 5. The vacuum control section 13 is controlled to vacuum the air in the inter-tube 22 and the connection tube 6 as well as in the container 5 so that the pressure of the airs in the inter-tube 22 and the connection tube 6 as well as in the container 5 is reduced to the vacuum pressure. After the container 5 is vacuumed, it is possible to prevent the resin 4 from being dropped through the discharge nozzle 3.

The pressure sensor 9 detects the air pressure of the inter-tube 22 to substantially detect the air pressure inside the container 5. The pressure sensor 9 generates analog signals of the air pressure detected. The analog signal of the air pressure is fetched and amplified by the amplifier 14. The amplified analog signal of the air pressure is fetched and analog-to-digital converted by the A/D converter 15 to generate digital signals of the air pressure. The digital signals of the air pressure is then fetched by the CPU 16 and transferred into the memory 17 for causing the memory 17 to store the digital signals of the air pressure as a measured air pressure value.

Subsequently, the first electromagnetic valve 10 is switched into the position "b" to connect the first inter-tube 22 to the second inter-tube 23. The second electromagnetic valve 11 is switched into a position "a" so that the first inter-tube 22 and the second inter-tube 23 are connected to the air intake 18 so as to cause the first inter-tube 22 and the second inter-tube 23 to have the atmospheric pressure. At this time, the discharge control section 12 and the vacuum control section 13 are controlled by the control section 25 to generate no output. After a predetermined time has been passed, the second electromagnetic valve 11 is switched into the position "b" so that the first inter-tube 22 and the second inter-tube 23 are disconnected from the air intake 18 whereby the internal pressure becomes stable. The vacuum control section 13 is controlled to vacuum the air in the first inter-tube 22 and the second inter-tube 23 so that the pressure of the airs in the first inter-tube 22 and the second inter-tube 23 is reduced to the vacuum pressure. The pressure of the air is almost the same between the first inter-tube 22 and the second inter-tube 23. The pressure sensor 9 detects the air pressure of the inter-tube 22 to substantially detect the air pressure of the first inter-tube 22 and the second inter-tube 23. The pressure sensor 9 generates analog signals of the air pressure. The analog signal of the reference air pressure is fetched and amplified by the amplifier 14. The amplified analog signal of the air pressure is fetched and analog-to-digital converted by the A/D converter 15 to generate digital signals of the reference air pressure. The digital signals of the reference air pressure is then fetched by the CPU 16 and transferred into the memory 17 for causing the memory 17 to store the digital signals of the reference air pressure as a measured air pressure value.

Subsequently, the first electromagnetic valve 10 is switched into the position "a" to connect the inter-tube 22 to the connection tube 6 and the container 5. The second electromagnetic valve 11 is switched into a position "b" so that the inter-tube 22 and the container 5 are connected to the high pressure air supply port 19 so as to supply the high pressure air to the inter-tube 22 and the container 5 whereby the inter-tube 22 and the container 5 have the high pressure which is almost the same pressure as the high pressure air supply port 19. The third electromagnetic valve 24 is switched to select the position "b" to connect the pressure sensor 9 to the discharge port 7 so that the pressure sensor 9 detects the air pressure of the container 5. At this time, the discharge control section 12 and the vacuum control section 13 are controlled by the control section 25 to enter into the operational state. The high pressure applied to the container 5 causes the resin 4 in the container 5 to be discharged from the discharge nozzle 3. As the resin 4 is discharged through the discharge nozzle 3 and the volume of the resin 4 in the container 5 is reduced, then the volume of the air in the container 5 is by contrast increased until all of the resin 4 in the container has been discharged and no residual resin 4 is present in the container 5 so that the volume of the air in the container S becomes maximum.

The increase in the volume of the air in the container 5 causes a variation in discharge pressure of the air in the container 5 even the constant high pressure remains applied to the container 5. Such variation in the discharge pressure of the air in the container 5 causes variations in the discharge amount of the resin 4. Optimum air pressure and pressure-applying time for ensuring stable and uniform discharge amount of the resin 4 against the variation in the volume of the air in the container 5 can be found experimentally. The experiment of discharging the resin has previously been carried out one time so that the profiles of the air pressure and the pressure-applying times have been obtained and measured values of the air pressure and the pressure-applying times are once stored in the memory 5. Thereafter, the internal air pressure of the container 5 or the amount of the residual resin 4 in the container 5 is measured to set or keep the optimum discharge conditions. Namely, the internal air pressure of the container 5 is varied depending upon the amount of the residual resin 4 in the container 5. The CPU 16 compares this variable internal air pressure of the container 5 to the air pressure of the predetermined volume container 8 to calculate the air volume or the volume of the residual resin 4.

The amount or volume of the residual resin 4 in the container 5 can be found from a difference or a rate between the measured pressure value and the reference pressure value, for which reason the amount of the residual resin 4 is found for subsequent comparison of the currently measured pressure value to the previously measured value stored in the memory 17 to compensate the air pressure so as to obtain optimum air pressure and air supply time or the pressure-applying time. Based upon those optimum air pressure and air supply time, the CPU 16 controls the discharge control section 12 to generate the optimum air pressure which is applied through the inter-tube 22 and the connection tube 6 to the container 5 whereby the contact amount of the resin is discharged anytime.

According to the above discharge system of the second embodiment of the present invention, the reference air pressure value is obtained by measuring the pressure of the air in a defined space having a predetermined or already known volume. The container air pressure value is obtained by measuring the pressure of the air in the container containing the resin. The amount of the residual resin in the container is found based upon both the reference air pressure value and the container air pressure value. The air pressure applied to the container containing the resin is controlled with reference to the amount of the residual resin in the container to always discharge the constant amount of the resin independent from the amount of the residual resin in the container.

Further, the above discharge system enables detection of any abnormal state having appeared on the air line system such as air leakage or disconnection between individual elements.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims any modifications of the present invention which fall within the spirit and scope of the present invention.

What is claimed is:

1. A system of discharging a material stored in a container through a discharge nozzle by an air pressure applied to an inside of said container, said system comprising:

a high pressure supplying means connected via an air line system to said container for supplying a high pressure air to the inside of said container;

a vacuum pressure applying means connected via said air line system to said container for applying a vacuum pressure to the inside of said container;

a pressure detecting means connected to said air line system for detecting a high pressure of said air line system to substantially detect a high pressure of the inside of said container when said high pressure is applied to the inside of said container, said pressure detecting means also detecting, as a reference pressure, a vacuum pressure of a restricted space region in said air line system when said vacuum pressure is applied to the inside of said container;

a residual amount computing means being electrically connected to said pressure detecting means for receipt of said high pressure and said reference pressure and computing a residual amount of said resin in said container based upon both said high pressure and said reference pressure and a pressure level and time adjusting means connected on said air line system between said high pressure air supply means and said container for adjusting both a pressure level of a supplying air through said air line system and a pressure-applying time during which said high pressure air is applied to the inside of said container, said pressure level and time adjusting means being further electrically connected to said residual amount computing means for receiving an information about said residual amount of said material in said container so that said pressure level and time adjusting means adjusts both said pressure level and said pressure-applying time in accordance with said residual amount of said material in said container to keep a constant discharge amount of said material through said discharge nozzle.

2. The system as claimed in claim 1, further comprising an atmospheric pressure supplying means connected via said air line system to said container for supplying an atmospheric pressure air to the inside of said container.

3. The system as claimed in claim 1, where in an empty subordinate container having a predetermined constant volume is provided which is connected via a switching valve to said air line system in parallel to said container containing said material so that said switching valve is switched to connect said empty subordinate container to said air line system for enabling said pressure detecting means to measure said reference pressure, whilst said switching valve is switched to connect said container to said air line system for enabling said pressure detecting means to measure a pressure of said container.

4. The system as claimed in claim 1, wherein a secondary switching valve is provided which is connected via a subordinate air line to said switching valve and also connected to said pressure detecting means as well as connected to said container in parallel to said switching valve so that said secondary switching valve is switched to connect said pressure detecting means to said subordinate air line for enabling said pressure detecting means to measure said reference pressure provided that said switching valve connects said subordinate air line to said air line system, whilst said secondary switching valve is switched to connect said pressure detecting means to said container for enabling said pressure detecting means to measure said pressure of said container provided that said switching valve connects said container to said air line system.

5. The system as claimed in claim 1, wherein said residual amount computing means includes a memory for storing information about said reference pressure by said pressure detecting means and a processing unit electrically connected to said memory for fetching said information about said reference pressure and also electrically connected to said pressure detecting means for fetching said pressure of said container so that said processing unit does compute said residual amount of said material detected by comparing said reference pressure to said pressure of said container.

6. A system of discharging a material stored in a container in successive material discharges through a discharge nozzle by a gas pressure applied to an inside of said container, said system comprising:

a high pressure supplying means connected via a gas line system to said container for supplying a high pressure gas to the inside of said container;

a pressure detecting means connected to said gas line system for detecting a high pressure of said gas line system to substantially detect a high pressure of the inside of said container when said high pressure is applied to the inside of said container, said pressure detecting means also detecting a reference pressure of a restricted space region in said gas line system when said high pressure is not applied to the inside of said container between successive material discharges so that said reference pressure is updated before each material discharge; and a control means being electrically connected to said pressure detecting means for receipt of said high pressure and said reference pressure and computing a residual amount of said resin in said container based upon both said high pressure and said reference pressure in order to adjust both a pressure level of a supplying gas through said gas line system and a pressure-applying time, during which said high pressure gas is applied to the inside of said container, with reference to said residual amount of said material in said container to thereby keep a constant discharge amount of said material through said discharge nozzle.

7. The system as claimed in claim 6, further comprising an atmospheric pressure supplying means connected via said gas line system to said container for supplying an atmospheric pressure air to the inside of said container.

8. The system as claimed in claim 6, wherein an empty subordinate container having a predetermined constant volume is provided which is connected via a switching valve to said gas line system in parallel to said container containing said material so that said switching valve is switched to connect said empty subordinate container to said gas line system for enabling said pressure detecting means to measure said reference pressure, whilst said switching valve is switched to connect said container to said gas line system for enabling said pressure detecting means to measure a pressure of said container.

9. The system as claimed in claim 6, wherein a secondary switching valve is provided which is connected via a subordinate gas line to said Switching valve and also connected to said pressure detecting means as well as connected to said container in parallel to said switching valve so that said secondary switching valve is switched to connect said pressure detecting means to said subordinate gas line for enabling said pressure detecting means to measure said reference pressure provided that said switching valve connects said subordinate air line to said air line system, whilst said secondary switching valve is switched to connect said pressure detecting means to said container for enabling said pressure detecting means to measure said pressure of said container provided that said switching valve connects said container to said gas line system.

10. The system as claimed in claim 6, wherein said control means includes a memory for storing information about said reference pressure detected by said pressure detecting means and a processing unit electrically connected to said memory for fetching said information about said reference pressure and also electrically connected to said pressure detecting means for fetching said pressure of said container so that said processing unit does compute said residual amount of said material by comparing said reference pressure to said pressure of said container.

11. The system as claimed in claim 6, further comprising a vacuum pressure applying means connected via said gas line system to said container for applying a vacuum pressure to the inside of said container so that said pressure detecting means detects said reference pressure.

12. A method of adjusting an amount of a material discharged in successive material discharges via a discharge nozzle from a container containing said material by applying a high pressure gas via a gas line system to an inside of said container, said method comprising the steps of:

detecting a reference pressure of a gas confined in a restricted space having a predetermined volume in said gas line system prior to each said material discharge;

detecting a high pressure of a gas applied to said inside of said container;

measuring a residual amount of said material in said container based upon said reference pressure and said high pressure; and adjusting both a pressure level of said high pressure gas and a pressure-applying time, during which said high pressure gas is applied to the inside of said container, with reference to said residual amount of said material in said container to thereby keep a constant discharge amount of said material through said discharge nozzle.

13. The method as claimed in claim 12, further comprising the step of applying an atmospheric pressure to said gas line system and said container to stabilize a gas pressure of said gas line system and said container before detecting said high pressure.

14. A method of controlling an amount of a material discharged in successive material discharges via a discharge nozzle from a container containing said material by applying a high pressure gas via a gas line system to an inside of said container, said method comprising the steps of:

detecting a reference pressure of a gas confined in a restricted space having a predetermined volume in said gas line system prior to each said material discharge;

detecting a high pressure of a gas applied to said inside of said container;

measuring a residual amount of said material in said container based upon said reference pressure and said high pressure;

computing both an optimum pressure level of said high pressure gas and an optimum pressure-applying time, during which said high pressure gas is applied to the inside of said container, with reference to said residual amount of said material in said container; and adjusting said high pressure and said pressure-applying time to said optimum pressure level and said optimum pressure-applying time thereby keeping a constant discharge amount of said material through said discharge nozzle.

15. The method as claimed in claim 14, further comprising the step of applying an atmospheric pressure to said gas line system and said container to stabilize a gas pressure of said gas line system and said container before detecting said high pressure.

16. A system of discharging a material stored in a container through a discharge nozzle by a gas pressure applied to an inside of said container, said system comprising:

a high pressure supplying means connected via a gas line system to said container for supplying a high pressure gas to the inside of said container;

a pressure detecting means connected to said gas line system for detecting a high pressure of said gas line system to substantially detect a high pressure of the inside of said container when said high pressure is applied to the inside of said container, said pressure detecting means also detecting a reference pressure of a restricted space region in said gas line system when said high pressure is not applied to the inside of said container;

a control means electrically connected to said pressure detecting means for receipt of said high pressure and said reference pressure and computing a residual amount of said resin in said container based upon both said high pressure and said reference pressure in order to adjust both a pressure level of a supplying gas through said gas line system and a pressure-applying time, during which said high pressure gas is applied to the inside of said container, with reference to said residual amount of said material in said container to thereby keep a constant discharge amount of said material through said discharge nozzle; and an atmospheric pressure air supplying means connected via said gas line system to said container for supplying an atmospheric pressure air to the inside of said container.

17. A system of discharging a material stored in a container through a discharge nozzle by a gas pressure applied to an inside of said container, said system comprising:

a high pressure supplying means connected via a gas line system to said container for supplying a high pressure gas to the inside of said container;

a pressure detecting means connected to said gas line system for detecting a high pressure of said gas line system to substantially detect a high pressure of the inside of said container when said high pressure is applied to the inside of said container, said pressure detecting means also detecting a reference pressure of a restricted space region in said gas line system when said high pressure is not applied to the inside of said container;

a control means electrically connected to said pressure detecting means for receipt of said high pressure and said reference pressure and computing a residual amount of said resin in said container based upon both said high pressure and said reference pressure in order to adjust both a pressure level of a supplying gas through said gas line system and a pressure-applying time, during which said high pressure gas is applied to the inside of said container, with reference to said residual amount of said material in said container to thereby keep a constant discharge amount of said material through said discharge nozzle; and an empty subordinate container having a predetermined constant volume connected via a switching valve to said gas line system in parallel to said container containing said material so that said switching valve is switched to connect said empty subordinate container to said gas line system for enabling said pressure detecting means to measure said reference pressure, whilst said switching valve is switched to connect said container to said gas line system for enabling said pressure detecting means to measure a pressure of said container.

18. A system of discharging a material stored in a container through a discharge nozzle by a gas pressure applied to an inside of said container, said system comprising:

a high pressure supplying means connected via a gas line system to said container for supplying a high pressure gas to the inside of said container;

a pressure detecting means connected to said gas line system for detecting a high pressure of said gas line system to substantially detect a high pressure of the inside of said container when said high pressure is applied to the inside of said container, said pressure detecting means also detecting a reference pressure of a restricted space region in said gas line system when said high pressure is not applied to the inside of said container;

a control means electrically connected to said pressure detecting means for receipt of said high pressure and said reference pressure and computing a residual amount of said resin in said container based upon both said high pressure and said reference pressure in order to adjust both a pressure level of a supplying gas through said gas line system and a pressure-applying time, during which said high pressure gas is applied to the inside of said container, with reference to said residual amount of said material in said container to thereby keep a constant discharge amount of said material through said discharge nozzle; and a secondary switching valve connected via a subordinate gas line to said switching valve and also connected to said pressure detecting means as well as connected to said container in parallel to said switching valve so that said secondary switching valve is switched to connect said pressure detecting means to said subordinate gas line for enabling said pressure detecting means to measure said reference pressure provided that said switching valve connects said subordinate air line to said air line system, whilst said secondary switching valve is switched to connect said pressure detecting means to said container for enabling said pressure detecting means to measure said pressure of said container provided that said switching valve connects said container to said gas line system.

19. A s system of discharging a material stored in a container through a discharge nozzle by a gas pressure applied to an inside of said container, said system comprising:

a high pressure supplying means connected via a gas line system to said container for supplying a high pressure gas to the inside of said container;

a pressure detecting means connected to said gas line system for detecting a high pressure of s aid gas line system to substantially detect a high pressure of the inside of said container when said high pressure is applied to the inside of said container, said pressure detecting means also detecting a reference pressure of a restricted space region in said gas line system when said high pressure is not applied to the inside of said container;

a control means electrically connected to said pressure detecting means for receipt of said high pressure and said reference pressure and computing a residual amount of said resin in said container based upon both said high pressure and said reference pressure in order to adjust both a pressure level of a supplying gas through said gas line system and a pressure-applying time, during which said high pressure gas is applied to the inside of said container, with reference to said residual amount of said material in said container to thereby keep a constant discharge amount of said material through said discharge nozzle; and a vacuum pressure applying means connected via said gas line system to said container for applying a vacuum pressure to the inside of said container so that said pressure detecting means detects said reference pressure.

20. A method of adjusting an amount of a material discharged via a discharge nozzle from a container containing said material by applying a high pressure gas via a gas line system to an inside of said container, said method comprising the steps of:

detecting a reference pressure of a gas confined in a restricted space having a predetermined volume in said gas line system;

detecting a high pressure of a gas applied to said inside of said container;

measuring a residual amount of said material in said container based upon said reference pressure and said high pressure;

adjusting both a pressure level of said high pressure gas and a pressure-applying time, during which said high pressure gas is applied to the inside of said container, with reference to said residual amount of s aid material in said container to thereby keep a constant discharge amount of said material through said discharge nozzle ; and applying an atmospheric pressure to said gas line system and said container to stabilize a gas pressure of said gas line system and said container before detecting said high pressure.

21. A method of controlling an amount of a material discharged via a discharge nozzle from a container containing said material by applying a high pressure gas via a gas line system to an inside of said container, said method comprising the steps of:

detecting a reference pressure of a gas confined in a restricted space having a predetermined volume in said gas line system;

detecting a high pressure of a gas applied to said inside of said container;

measuring a residual amount of said material in said container based upon said reference pressure and said high pressure;

computing both an optimum pressure level of said high pressure gas and an optimum pressure-applying time, during which said high pressure gas is applied to the inside of said container, with reference to said residual amount of said material in said container;

adjusting said high pressure and said pressure-applying time to said optimum pressure level and said optimum pressure-applying time thereby keeping a constant discharge amount of said material through said discharge nozzle; and applying an atmospheric pressure to said gas line system and said container to stabilize a gas pressure of said gas line system and said container before detecting said high pressure.

* * * * *